US012214811B2

(12) United States Patent
Graf

(10) Patent No.: US 12,214,811 B2
(45) Date of Patent: Feb. 4, 2025

(54) ANTI-CLIMBING DEVICE

(71) Applicant: Siemens Mobility Austria GmbH, Vienna (AT)

(72) Inventor: Richard Graf, Vienna (AT)

(73) Assignee: Siemens Mobility Austria GmbH, Vienna (AT)

( * ) Notice: Subject to any disclaimer, the term of this patent is extended or adjusted under 35 U.S.C. 154(b) by 739 days.

(21) Appl. No.: 17/598,772

(22) PCT Filed: Mar. 16, 2020

(86) PCT No.: PCT/EP2020/057139
§ 371 (c)(1),
(2) Date: Sep. 27, 2021

(87) PCT Pub. No.: WO2020/193257
PCT Pub. Date: Oct. 1, 2020

(65) Prior Publication Data

US 2022/0250662 A1 Aug. 11, 2022

(30) Foreign Application Priority Data

Mar. 28, 2019 (AT) ..... A 50266/2019

(51) Int. Cl.
*B61G 11/18* (2006.01)
*B61F 19/04* (2006.01)

(52) U.S. Cl.
CPC ..... *B61G 11/18* (2013.01); *B61F 19/04* (2013.01)

(58) Field of Classification Search
CPC ..... B61G 11/18; B61F 19/04
See application file for complete search history.

(56) References Cited

U.S. PATENT DOCUMENTS 6,729,451 B2 * 5/2004 Yamagiwa ..... B62J 27/30 188/377
7,866,716 B2 * 1/2011 Perucca ..... B60R 19/18 293/133
2012/0104778 A1 * 5/2012 Mana ..... B60R 19/18 264/269

(Continued)

FOREIGN PATENT DOCUMENTS

CN 204915710 U 12/2015
CN 104176083 B 9/2016

(Continued)

OTHER PUBLICATIONS

PCT International Search Report dated Jun. 9, 2020 based on PCT/EP2020/057139 filed Mar. 16, 2020.

*Primary Examiner* — Scott A Browne
(74) *Attorney, Agent, or Firm* — Cozen O'Connor

(57) ABSTRACT

Anti-climbing device for a rail vehicle includes a baffle plate, wherein a plurality of mutually parallel protruding first formations are arranged along a linear path on the baffle plate, and a plurality of mutually parallel protruding second formations are arranged along a linear path on the baffle plate and are orientated normally with respect to the first formations, where the extent of the second formations over the face of the baffle plate is smaller than the extent of the first formations over the face of the baffle plate, and where the first formations, at intersection locations of the formations, each have a recess in which the extent of the first formation is reduced.

14 Claims, 3 Drawing Sheets

(56) References Cited

U.S. PATENT DOCUMENTS

2020/0122752 A1* 4/2020 Luo ..... B61F 19/04

FOREIGN PATENT DOCUMENTS

| | | |
|---|---|---|
| DE | 3228942 | 2/1984 |
| DE | 102006050028 | 4/2008 |
| EP | 2727792 | 5/2014 |
| FR | 776284 | 1/1935 |
| JP | 2002-046601 | 2/2002 |
| KR | 20120007114 | 1/2012 |
| PL | 401484 | 5/2014 |
| WO | 2015039679 | 3/2015 |

* cited by examiner

ANTI-CLIMBING DEVICE

CROSS-REFERENCE TO RELATED APPLICATIONS

This is a U.S. national stage of application No. PCT/EP2020/057139 filed 16 Mar. 2020. Priority is claimed on Austrian Application No. A50266/2019 filed 28 Mar. 2019, the content of which is incorporated herein by reference in its entirety.

BACKGROUND OF THE INVENTION

1. Field of the Invention

The invention relates to safety devices and, more particularly, to an anti-climbing device for a rail vehicle.

2. Description of the Related Art

In the event of head-on collisions of rail vehicles, the collision forces that occur are intended to be introduced into the sub-assemblies that are constructed to absorb and convert the collision energy into deformation energy. These sub-assemblies are typically configured as "energy consumption elements" that can be deformed over a specific deformation path and that, in this instance, have a specially configured force/path characteristic. If the energy absorption capacity of such elements is exhausted, the additional collision energy is introduced into the vehicle structure. Here, it should be noted that the underframe of a rail vehicle is constructed in a considerably sturdier manner than all the other sub-assemblies, in particular the side walls, end walls and the roof. During a collision of two rail vehicles, one of the rail vehicles may move such that the underframe thereof is pushed over the underframe of the other vehicle (i.e., it climbs) and thus loads the considerably less sturdy region above the underframe with collision energy. This can easily occur in the event of a vertical offset of the colliding vehicles and potentially leads to catastrophic consequences of accidents because the passenger compartment of one of the vehicles can be extensively destroyed in this instance. In order to prevent this effect, anti-climbing devices ("anti-climbers") that fix the vehicles in their vertical position with respect to each other in the event of a collision are used. These anti-climbing devices are typically provided at those locations of the vehicles that first collide with another vehicle and comprise a plate with a horizontally orientated rib structure. These rib structures of the colliding anti-climbing devices engage in each other in the event of a collision and form a positive-locking connection that prevents vertical sliding of the anti-climbing devices with respect to each other. However, if the colliding anti-climbing devices have a horizontal displacement with respect to each other, i.e., if the anti-climbing devices overlap only partially in a lateral direction, then the torques that are produced can rotate the securing device of the anti-climbing devices such that the anti-climbing devices laterally slide against each other and, as a consequence, they subsequently lose their effect. This may occur particularly when the face of the anti-climbing device that is configured with a rib structure has relatively small dimensions and a horizontal offset accordingly has a greater effect. The sliding against each other may, however, also be brought about by forces occurring in a lateral direction (for example, collision on a bend). In order to overcome this shortcoming, baffle plates that enable a tooth arrangement over the entire surface, for example, using pyramid-like protrusions, are provided. However, these plates can act exclusively with identical baffle plates and can only be produced in a costly manner.

SUMMARY OF THE INVENTION

In view of the foregoing, it is therefore an object of the invention to provide an anti-climbing device for a rail vehicle which, even in the event of horizontally offset collisions with another anti-climbing device or in the event of lateral forces occurring, prevents lateral sliding.

This and other objects and advantages are achieved in accordance with the invention by an anti-climbing device for a rail vehicle that comprises a baffle plate, wherein a plurality of mutually parallel protruding first formations are arranged along a linear path on the baffle plate, and furthermore a plurality of mutually parallel protruding second formations are arranged on the baffle plate along a linear path and are orientated normally with respect to the first formations, where the extent of the second formations over the face of the baffle plate is smaller than the extent of the first formations over the face of the baffle plate, and where the first formations each have a recess, at intersection locations of the formations, in which the extent of the first formation is reduced.

The advantage can thereby be afforded of being able to provide an anti-climbing device which, in addition to preventing the "climbing action", also prevents identical anti-climbing devices from sliding horizontally against each other in the event of a collision. In this manner, in the event of a lateral offset of colliding anti-climbing devices, the introduction of force into energy consumption elements that are arranged behind the anti-climbing devices can be optimized and, in this instance, the energy consumption capacity thereof can also be used to the fullest possible extent.

In accordance with the invention, the anti-climbing device comprises a baffle plate, which is typically constructed in a rectangular or square manner, and on this baffle plate formations that are arranged at the impact side. In this instance, there are intended to be provided a plurality of first formations that protrude in the manner of ribs from the baffle plate and which, in the installation position of the anti-climbing device, are orientated horizontally. This configuration is similar to the anti-climbing devices known from the prior art. The invention further provides a plurality of second formations that also protrude in the manner of ribs from the baffle plate, where the first and second formations are orientated at right-angles with respect to each other. In the installation position of the anti-climbing device, the second formations are consequently arranged in a vertical manner. The height (extent) of the second formations over the face of the baffle plate is, in this instance, intended to be configured to be smaller than the extent of the first formation over the face of the baffle plate. At the locations at which the first formations intersect with the second formations, recesses are intended to be provided in the first formations, in which the height (extent) of the first formation is reduced locally, over a specific length.

Consequently, when identical anti-climbing devices in accordance with the invention collide, an interlocking of the second (vertical) formations in the recesses of the first (horizontal) formations can occur and the anti-climbing devices are consequently prevented from sliding against each other in all directions.

The width of the recesses in the first formations is intended to be configured at least with the width of the second formations so that the second, vertical formations can engage in these recesses. It is particularly advantageous to configure the recesses in the first formations to be wider than the width of the second formations so that a secure engagement during a horizontal relative movement of colliding anti-climbing devices is ensured. The width of the recesses determines, in this instance, a distance (range) within which an engagement can be implemented.

The shape of the recesses in the first formations, i.e., their cross section when viewed vertically, may be configured in a rectangular or trapezoidal manner, for example.

It is advantageous to reduce the extent of the first formation in the region of the recesses to the extent of the second formation. In this manner, the advantage is intended to be afforded that, when identical anti-climbing devices engage with each other, a complete tooth arrangement is achieved, where the first formations of each of the two anti-climbing devices come into contact with the surface of the corresponding baffle plate and where the second formations come into contact with the first formations of the corresponding baffle plate in the region of the recesses. As a result of this optimal tooth arrangement, full use can be made of the strength of the anti-climbing devices. This geometric optimum potentially cannot be achieved under real conditions of use in the event of impacts, for example, as a result of objects which are jammed between the anti-climbing devices, for example, components of a vehicle trim. Consequently, it is advantageous to configure the extent of the second formation to be larger than the entire thickness of the objects (in particular trim components) that may become jammed between the anti-climbing devices.

The production of an anti-climbing device in accordance with the invention may be achieved from materials that are conventional for anti-climbing devices, in particular from steel or a light metal alloy.

In climbing devices, dimensions of the baffle plates of approximately 300 mm for the side length are typical. These dimensions, and a spacing of the first formations of typically 60 mm is also feasible with an anti-climbing device in accordance with the invention so that a compatibility with conventional anti-climbing devices is produced. When an anti-climbing device in accordance with the invention collides with a conventional anti-climbing device, protection against climbing is provided. Protection against horizontal sliding can, however, only be achieved in conjunction with an additional anti-climbing device in accordance with the invention.

In a preferred embodiment of the invention, the extent of the second formation over the baffle plate is reduced to zero, thus allowing the extent to be dispensed with. At the same time, however, the recesses are intended to be provided in the first recesses. In this manner, a horizontal rib structure that is provided with a tooth arrangement is produced. This tooth arrangement can engage in anti-climbing devices with a structure of second formations and can consequently prevent the anti-climbing devices from sliding horizontally against each other. The presently contemplated embodiment of is particularly advantageous for redesigning existing conventional anti-climbing devices because, in this instance, only the recesses in the horizontal formations have to be produced. This redesign can also be implemented in anti-climbing devices that are in use, where only the removal of material is required, but not the application of a structure of second formations. The protection against horizontal sliding occurs, in this instance, only in the event of a collision with an anti-climbing device having a complete formation structure in accordance with disclosed embodiments of the invention.

An anti-climbing device in accordance with the disclosed embodiment of the invention can be produced, for example, using a casting method and also via a forging method or the rib structure may be milled from a baffle plate that is configured to be correspondingly thicker. In particular, it is advantageous to weld an anti-climbing device in accordance with the disclosed embodiments of the invention from individually prefabricated components (baffle plate, first and second formations). The simple geometry of these individual components enables simple prefabrication.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS

Figure 1:
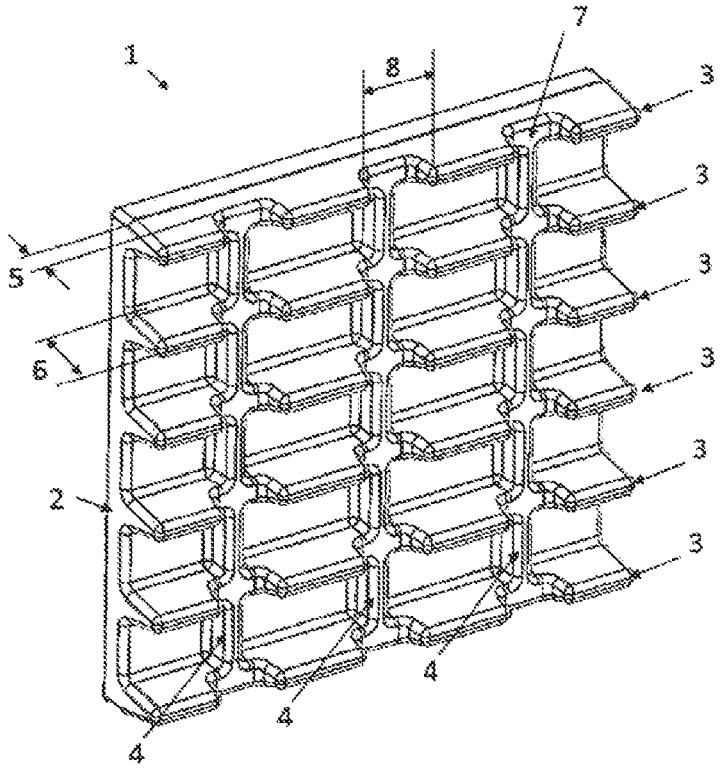
FIG. 1 shows an anti-climbing device in accordance with the invention.

FIG. 1 is an exemplary schematic illustration of an anti-climbing device. The anti-climbing device 1 comprises a baffle plate 2, a plurality of first formations 3 and a plurality of second formations 4. The baffle plate 2 is configured in a rectangular manner and has a rib structure of mutually parallel first formations 3. There are shown by way of example six first formations 3 that each protrude by an extent 6 from the baffle plate 2. The anti-climbing device 1 is illustrated in the position for use thereof, in which the first formations 3 are orientated horizontally. Additional components, such as a vehicle structure that is located behind the anti-climbing device 1 or an energy consumption element, are not illustrated in FIG. 1. Furthermore, the anti-climbing device 1 comprises a plurality of second formations 4 that are orientated normally with respect to the first formations 3 and that protrude by an extent 5 from the baffle plate 2. For example, three second formations 4 are illustrated. At the intersection locations 7 between the first formations 3 and second formations 4, a recess 8 is provided in each case in the first formations 3. These recesses 8 have a specific width, where, in FIG. 1, this width is configured to be larger than the width of the second formations 4, whereby a larger range is achieved. In the illustrated embodiment, the extent of the first formations 3 in the recesses 8 is reduced to the extent 5 of the second formations 4.

Figure 2:
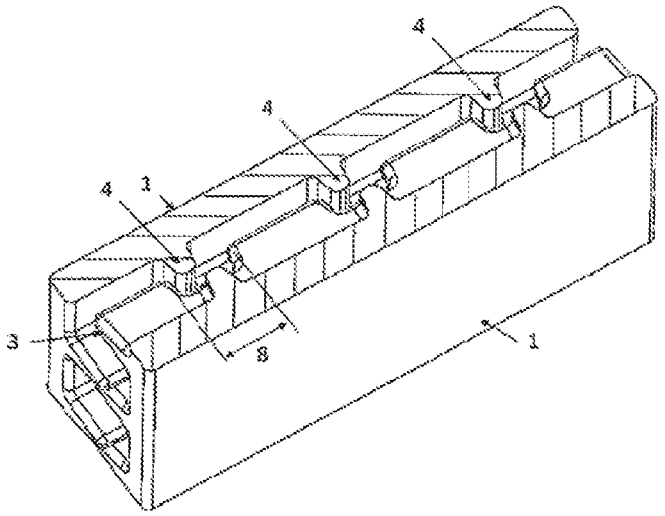
FIG. 2 shows a detailed cross-sectional schematic illustration of two anti-climbing devices while engaged with each other in accordance with the invention.

FIG. 2 is an exemplary and schematic detailed illustration of two anti-climbing devices that are in engagement. A horizontal section through two anti-climbing devices 1 which are in engagement is illustrated, where the second formations 4 of an anti-climbing device 1 engage in the recesses 8 of the first formations 3 of a second anti-climbing device 1. The anti-climbing devices 1 are shown in a state engaged in an end position, in which the second formations abut the edge of the formations 8 and a further horizontal displacement of the anti-climbing devices 1 with respect to each other is prevented.

Figure 3:
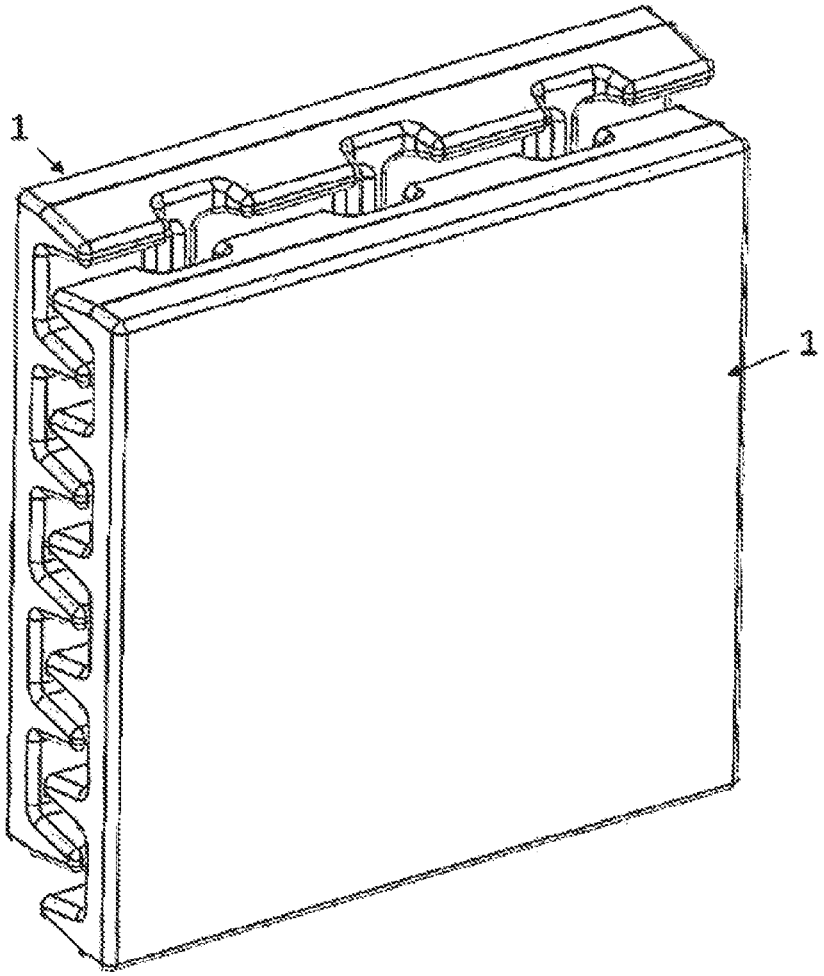
FIG. 3 shows two anti-climbing devices in engagement while engaged with each other in accordance with the invention.

FIG. 3 is an exemplary and schematic illustration of two anti-climbing devices that are in engagement with each other. An overall view of two anti-climbing devices 1 that are in engagement with each other is shown.

Figure 4:
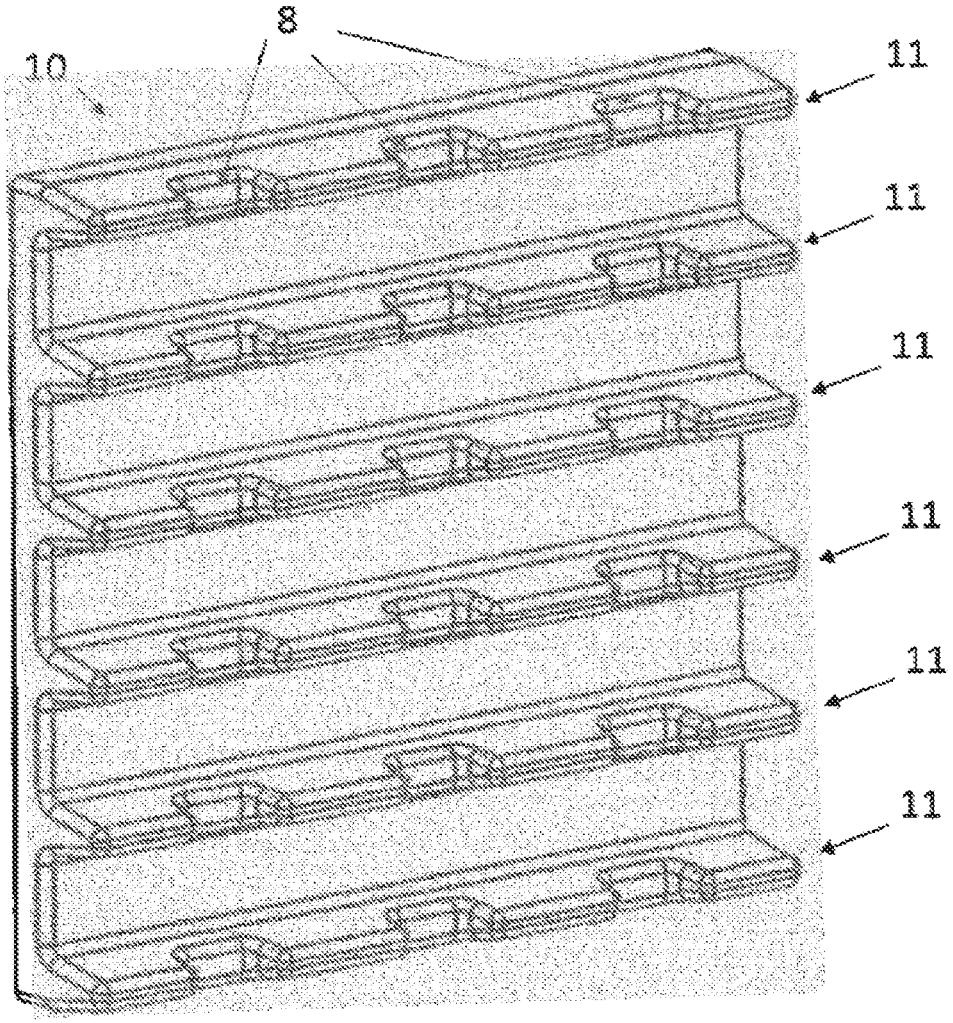
FIG. 4 shows an anti-climbing device with a tooth structure in accordance with the invention.

FIG. 4 shows by way of example an anti-climbing device having a tooth structure. Here, an anti-climbing device 10 that comprises a plurality of formations that are orientated horizontally in the installation position with a tooth structure 11 is illustrated. The vertically orientated second formations are reduced to zero in terms of their extent. In the formations with a tooth structure 11, there are provided recesses 8 that are spaced apart from each other such that an anti-climbing device with a tooth structure 11 can engage in an anti-climbing device 1, as illustrated in FIG. 1, and consequently horizontal forces can be transmitted between the anti-climbing devices 1 and 10.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An anti-climbing device for a rail vehicle comprising:
a baffle plate;
a plurality of mutually parallel protruding first formations arranged along a linear path on the baffle plate;
a plurality of mutually parallel protruding second formations arranged on the baffle plate along another linear path and orientated normally with respect to the first formations;
wherein an extent of the second formations over a face of the baffle plate is smaller than an extent of the first formations over the face of the baffle plate; and
wherein at intersection locations of the first and second formations the first formations each have a recess in which the extent of the first formations is reduced.

2. The anti-climbing device as claimed in claim 1, wherein the extent of the first formation in a region of the recesses is reduced to the extent of the second formations.

3. The anti-climbing device as claimed in claim 1, wherein the extent of the first formations in the region of the recesses is reduced to a lower value than the extent of the second formations.

4. The anti-climbing device as claimed claim 1, wherein the recesses have a rectangular cross section.

5. The anti-climbing device as claimed in claim 2, wherein the recesses have a rectangular cross section.

6. The anti-climbing device as claimed in claim 3, wherein the recesses have a rectangular cross section.

7. The anti-climbing device as claimed in claim 1, wherein the recesses have a trapezoidal cross section.

8. The anti-climbing device as claimed in claim 2, wherein the recesses have a trapezoidal cross section.

9. The anti-climbing device as claimed in claim 3, wherein the recesses have a trapezoidal cross section.

10. The anti-climbing device as claimed in claim 1, wherein the baffle plate is connected to the first and second formations in a non-releasable manner via a welding method.

11. The anti-climbing device as claimed in claim 1, wherein the baffle plate is produced together with the first and second formations in an integral manner via a milling method.

12. The anti-climbing device as claimed in claim 1, wherein the baffle plate is produced together with the first and second formations in an integral manner via a forging method.

13. The anti-climbing device as claimed in claim 1, wherein the baffle plate is produced together with the formations in an integral manner via a casting method.

14. An anti-climbing device for a rail vehicle comprising:
a baffle plate;
a plurality of mutually parallel protruding first formations arranged along a linear path on the baffle plate;
a plurality of mutually parallel protruding second formations arranged on the baffle plate along another linear path and orientated normally with respect to the first formations;
wherein an extent of the second formations over a face of the baffle plate is smaller than an extent of the first formations over the face of the baffle plate;
wherein at intersection locations of the first and second formations the first formations each have a recess in which the extent of the first formations is reduced; and
wherein the extent of the first formation in a region of the recesses is reduced to the extent of the second formations.

* * * * *